United States Patent [19]

Boardman

[11] Patent Number: 5,016,874

[45] Date of Patent: May 21, 1991

[54] MULTI-DIRECTIONAL EXERCISE DEVICE

[76] Inventor: Perry K. Boardman, P.O. Box 3073, Sierra Vista, Ariz. 85636-3073

[21] Appl. No.: 379,966

[22] Filed: Jul. 14, 1989

Related U.S. Application Data

[63] Continuation-in-part of Ser. No. 346,558, May 1, 1989, abandoned.

[51] Int. Cl.[5] ..... A63B 21/04

[52] U.S. Cl. ..... 272/137; 272/135

[58] Field of Search ..... 272/116, 135, 136, 142, 272/143, 137–141, 65, 66; 446/486, 490

[56] References Cited

U.S. PATENT DOCUMENTS

| | | | |
|---|---|---|---|
| 2,467,943 | 3/1949 | Mikell, Jr. | 272/96 |
| 4,241,914 | 12/1980 | Bushnell | 272/136 |
| 4,268,031 | 5/1981 | Schomburg | 272/142 |

FOREIGN PATENT DOCUMENTS

| | | | |
|---|---|---|---|
| 1289516 | 2/1987 | U.S.S.R. | 272/135 |

*Primary Examiner*—Richard J. Apley
*Assistant Examiner*—L. Thomas

[57] ABSTRACT

A multi-directional, portable exerciser which includes a square frame, a bar within the frame, and elastic members attached to the bar and the frame. The bar can be pushed, pulled or twisted in any direction; therefore, making it possible to perform a wide variety of exercises without having to change the position of the exerciser.

2 Claims, 1 Drawing Sheet

MULTI-DIRECTIONAL EXERCISE DEVICE

This application is a continuation-in-part of application Ser. No. 346,558, filed May 1, 1989, now abandoned.

BACKGROUND OF THE INVENTION

This invention relates to exercisers in general, and more particularly to a device for strengthening the muscular system of the human body.

One of the most prominent means of exercising has been weightlifting. Weights are placed on each end of a bar and lifted in various ways. Lifting weights requires much physical exertion which can strain or pull muscles. Also weights are difficult to transport.

These problems have been resolved with the invention of exercisers which require the use of springs. However, springs wear out more quickly than rubber, and many of these types of exercisers do not provide for building the body thoroughly, nor do they provide movement in more than two directions.

Exercisers most similar to the present invention include: U.S. Pat. No. 4,241,914—Bushnel; U.S. Pat. No. 4,293,127—Dudley; U.S. Pat. No. 4,406,453—Herzfeld; and Foreign Pat. No. 3,004,214—Baeurle.

Bushnell discloses an elastic exercise apparatus which includes a frame with at least one elastic member attached to both ends of the frame. The position of the elastic member in the frame is adjustable, but its movement is only bi-directional; therefore, the number of exercises which can be done is limited.

Dudley discloses a mono-kinetic exercise device which has to be mounted to a doorway or another frame. If has one bar in the center which is secured by ropes and moves in only two directions.

Herzfeld discloses an exercise device which includes a frame having a fixed handle on each end and a sliding handle in the center. Springs are attached to the center handle and the end handles so that the center handle can be moved in only two directions.

Baeurle discloses an exercise device which includes a frame having rods with springs attached to the rods and the frame. The rods can only be moved in one direction.

SUMMARY OF THE INVENTION

The main object of the present invention is to provide an improved means for developing the entire body.

The present invention includes a square frame, a bar within the frame, and elastic members attached to the bar and the frame. The bar can pushed, pulled, or twisted in any direction; therefore, making it possible to perform a wide variety of exercises without having to change the position of the exerciser.

Another object of the present invention is to provide an exerciser which is easy to store and transport. This is made possible because of the present invention's small size and light weight.

DETAILED DESCRIPTION OF THE PREFERRED EMBODIMENT

In order to explain the structure and function of the present invention, reference will now be made to the drawings.

Figure 1:
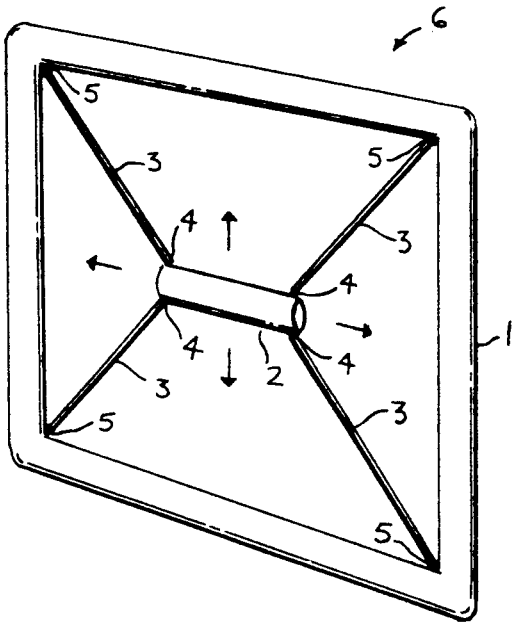
FIG. 1 is a perspective view of the present invention.
Figure 2:
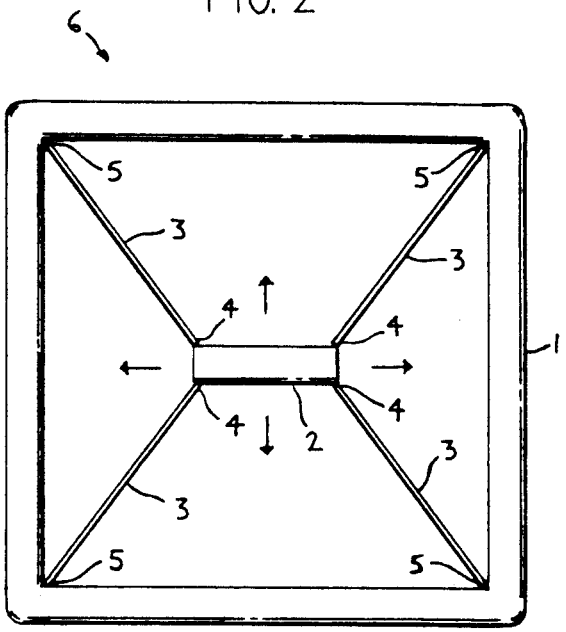
FIG. 2 is a front view of the present invention.

In FIGS. 1 and 2 the exerciser (6) is illustrated. It is comprised of a square frame (1), having tubular sides a straight tubular bar (2), four elastic members (3), and eight hooks (4,5). The frame (1) is approximately twenty-two inches high, twenty-two inches wide, and two inches deep.

The bar (2) is evenly space within the center of the frame (1). Elastic members (3) are attached to the top and bottom edges of the bar (2) and the inside corners of the frame (1) by means of hooks (4,5).

Figure 3:
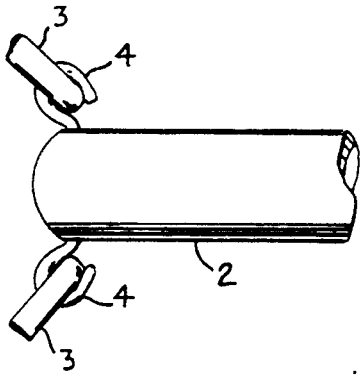
FIG. 3 is a sectional view showing how the elastic members are attached to the bar.

FIG. 3 illustrates how the elastic members (3) are attached to the bar (2). They are securely attached to hooks (4) on the bar (2).

Figure 4:
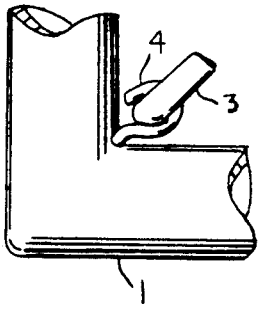
FIG. 4 is a sectional view showing how the elastic members are attached to the frame.

FIG. 4 illustrates how the elastic members (3) are attached to the frame (1). They are securely attached to hooks (5) on the frame (1).

Exercises are performed by pulling, pushing, or twisting the bar (2) by itself or in conjunction with the frame 1. This can be done with different parts of the body and in various positions. Since the frame is tubular, it can be held comfortably with the hand when exercising. The following are examples of exercises which can be performed: To build the arms and shoulders, the bar (2) is pulled up or pushed down with one or both hands. To build the chest, the side of the frame (1) is held with one hand, and the bar (2) is pushed towards it or pulled away from it with the other hand. To build the forearms, the bar (2) is twisted with the hand in any direction. To build the thighs, the frame (1) is held with one foot, and the bar (2) is pushed towards it or pulled away from it with the other foot. To build the calves, the bar (2) is pushed down with the toes. To build the back and neck, the sides of the frame (1) are held with the hands; the head is placed through the frame (1) with the back of the neck under the bar (2), and the neck is moved upwards.

The preceding description of the preferred embodiment is not meant to be limiting. The following claims are meant to cover any modifications which are in the realm of the present invention.

What is claimed is:

1. An exerciser comprising:

a frame consisting of four tubular sides of equal length with four inside corners, said frame defining a plane;

a straight tubular bar having ends remote from each other and a top and bottom edge at each said end; and elastic members mounted to said corners of said frame and said edges of said bar such that said bar is contained within the plane of said frame when said bar is in a rest position.

2. An exerciser as defined in claim 1 wherein said bar is slidably mounted within said frame so as to provide movement in any direction.

* * * * *